US006153351A

United States Patent [19]

Gula et al.

[11] Patent Number: 6,153,351

[45] Date of Patent: Nov. 28, 2000

[54] IMAGING ELEMENT WITH THIN BIAXIALLY ORIENTED COLOR LAYER

[75] Inventors: Thaddeus S. Gula, Rochester; Peter T. Aylward, Hilton; Robert P. Bourdelais, Pittsford; Douglas N. Haydock, Webster, all of N.Y.

[73] Assignee: Eastman Kodak Company, Rochester, N.Y.

[21] Appl. No.: 09/396,575

[22] Filed: Sep. 15, 1999

Related U.S. Application Data

[63] Continuation of application No. 08/998,359, Dec. 24, 1997, Pat. No. 6,001,547.

[51] Int. Cl.[7] ..... G03C 1/79; G03C 1/795; G03C 1/835; G03C 8/52

[52] U.S. Cl. ..... 430/201; 430/200; 430/212; 430/496; 430/510; 430/517; 430/536; 347/106; 503/227

[58] Field of Search ..... 430/536, 201, 430/200, 212, 510, 517, 533, 534, 496; 347/106; 503/227

[56] References Cited

U.S. PATENT DOCUMENTS

| | | | |
|---|---|---|---|
| 4,187,113 | 2/1980 | Mathews et al. | 430/533 |
| 4,255,516 | 3/1981 | Katoh et al. | 430/533 |
| 4,283,486 | 8/1981 | Aono et al. | 430/538 |
| 4,377,616 | 3/1983 | Ashcraft et al. | 428/213 |
| 4,601,976 | 7/1986 | Karino | 430/496 |
| 4,632,869 | 12/1986 | Park et al. | 430/315.5 |
| 4,758,462 | 7/1988 | Park et al. | 428/315.5 |
| 4,912,333 | 3/1990 | Roberts et al. | 250/487.1 |
| 4,990,432 | 2/1991 | Komatsu et al. | 430/510 |
| 4,994,312 | 2/1991 | Maier et al. | 428/36.5 |
| 5,232,825 | 8/1993 | Hattori et al. | 430/517 |
| 5,244,861 | 9/1993 | Campbell et al. | 430/201 |
| 5,288,570 | 2/1994 | Von Trebra et al. | 430/510 |
| 5,290,672 | 3/1994 | Dunk | 430/538 |
| 5,429,916 | 7/1995 | Ohshima | 430/538 |
| 5,466,519 | 11/1995 | Shirakura et al. | 430/538 |
| 5,476,708 | 12/1995 | Reed et al. | 430/538 |
| 5,480,767 | 1/1996 | Tosaka et al. | 430/510 |
| 5,514,460 | 5/1996 | Surman et al. | 428/304.4 |

FOREIGN PATENT DOCUMENTS

| | | |
|---|---|---|
| 0 585 679 | 3/1994 | European Pat. Off. . |
| 0 666 183 | 8/1995 | European Pat. Off. . |
| 0 757 284 | 2/1997 | European Pat. Off. . |
| 0 803 377 A1 | 10/1997 | European Pat. Off. . |

*Primary Examiner*—Richard L. Schilling
*Attorney, Agent, or Firm*—Paul A. Leipold

[57] ABSTRACT

The invention relates to a photographic element comprising a paper base, at least one photosensitive silver halide layer, a layer of polymer sheet between said paper base and said silver halide layer, incorporating a thin tinted polymer layer directly below said silver halide layer.

37 Claims, No Drawings

IMAGING ELEMENT WITH THIN BIAXIALLY ORIENTED COLOR LAYER

This is a continuation of application Ser. No. 08/998,359, filed Dec. 24, 1997, now U.S. Pat. No. 6,001,547

FIELD OF THE INVENTION

This invention relates to photographic materials. In a preferred form it relates to base materials for photographic color papers.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. It would be desirable if a more reliable and improved surface could be formed at less expense.

In photographic papers the polyethylene layer also serves as a carrier layer for titanium dioxide and other whitener materials as well as tint materials. It would be desirable if the colorant materials rather than being dispersed throughout the polyethylene layer could be concentrated nearer the surface of the layer where they would be more effective photographically.

Prior art photographic materials have suggested coextruded layer coatings on paper base that are thicker and/or more concentrated with titanium dioxide ($TiO_2$) and colorants than monolayers. Other high refractive index materials like zinc oxide or other finely divided solids are also used. In general, these improvements are costly and processing and coating these concentrated layers create manufacturing problems with specks, lines and surface disruptions. The highly loaded layers deteriorate the strength property of the coatings and may result in poor adhesion to the base paper or to the image bearing emulsion layer. Also, the coating speed of these layers may be lower.

The details of an invention and a description of the problems encountered with highly loaded coextruded layers is recorded in U.S. Pat. No. 5,466,519.

It has been proposed in U.S. Pat. No. 5,244,861 to utilize biaxially oriented polypropylene in receiver sheets for thermal dye transfer. As will be shown, these materials appear to have very unique abilities to optimize thin layers for improved colorimetric performance.

An example of coextruded thin layer technology improvements and limitations is explained in U.S. Pat. No. 5,476,708 where it is proposed that sharpness improvements in photographic systems can be achieved by an untinted, unpigmented thin skin made to be used under a light sensitive emulsion. A crude correlation is made suggesting that, if the limits of coextrusion technology are pushed to the maximum, a clear layer of thickness as low as 1.5 micrometers is the optimum for optical photographic response.

PROBLEM TO BE SOLVED BY THE INVENTION

There remains a need for a more effective layer between the photosensitive layers and the base paper to more effectively carry colorant materials to create major improvements in optical performance properties that are practical, manufacturable, and cost effective.

SUMMARY OF THE INVENTION

An object of the invention is to provide improved photographic papers.

It is an object of the invention to provide photographic images that have improved image reproduction.

It is another object of the invention to reduce the amount of tinting agents used in the prior art.

It is another object of the invention to provide photographic elements that can be easily manufactured without adhesion problems, lines, or spots.

It is another object of the invention to provide photographic elements that can be coated at very high speed.

It is another object of the invention to provide photographic elements that have extremely thin, accurate, useful layers that exceed the photographic properties of prior art.

These and other objects of the invention are generally accomplished by an imaging element comprising an image carrying layer, and a substrate comprising a colored layer, wherein said colored layer is between about 0.2 micrometers and 1.5 micrometers in thickness.

Another embodiment of the invention is accomplished by a method of forming a photographic element comprising providing a preformed biaxially oriented polyolefin sheet, providing a base paper, applying a bonding agent onto said base paper and simultaneously applying said sheet to said bonding agent to join said sheet to said base paper.

ADVANTAGEOUS EFFECT OF THE INVENTION

The invention provides an improved base for casting of photosensitive layers. It particularly provides improved base for color photographic materials that have more cost effective and higher quality images. The invention provides an extremely thin colored layer to be used directly under an emulsion, this type of layer cannot be formed reliably by any previous art.

DETAILED DESCRIPTION OF THE INVENTION

There are numerous advantages of the invention over prior practices in the art. The invention provides a photographic paper that is much lower in cost as the criticalities of the formation of the polyethylene are removed. There is no need for the difficult and expensive casting and cooling in forming a surface on the polyethylene layer as the biaxially oriented polymer sheet of the invention provides a high quality surface for casting of photosensitive layers. The photographic materials of the invention are lower in cost to produce as the colored coextruded sheet may be scanned for quality prior to assembly into the photographic member. With present polyethylene layers the quality of the layer cannot be assessed until after complete formation of the base paper with the polyethylene waterproofing layer attached. Therefore, any defects result in expensive discard of expensive product. These and other advantages will be apparent from the detailed description below. The various coextruded and biaxially oriented layers have levels of $TiO_2$ and colorants adjusted to provide optimum optical properties.

One surprising detail of this invention is the finding that a very thin coating (0.2 to 1.5 micrometers) on the surface immediately below the emulsion layer can be made by coextrusion and subsequent stretching in the width and length. It has been found that this layer is, by nature, extremely accurate in thickness and can be used to provide all the color corrections which are usually distributed throughout the thickness of the sheet between the emulsion and the paper base. This topmost layer is so efficient that the total colorants needed to provide a correction are less than one-half the amount needed if the colorants are dispersed throughout thickness. Colorants are often the cause of spot defects due to clumps and poor dispersions. Spot defects are reduced with this invention because less colorant is used and high quality filtration to remove clumps from the colored layer is much more feasible since the total volume of polymer with colorant is only typically 2 to 10 percent of the total polymer between the base paper and the photosensitive layer.

Another benefit of the thin colored layer is that it does not need to contain any pigments like $TiO_2$. In this way, the dispersion quality of the topmost layer is improved because dissimilar materials are not used. $TiO_2$ or other pigments are normally mandatory directly under the emulsion for optimum image properties like sharpness. It has been found that the thin layer of this invention has the same optical performance with or without pigments because it is so thin.

The terms as used herein, "top", "upper", "emulsion side", and "face" mean the side or toward the side of the photographic member bearing the image or imaging layers. The terms "bottom", "lower side", and "back" mean the side or toward the side of the photographic member opposite from the side beating the photosensitive imaging layers or developed or printed image.

Any suitable biaxially oriented polyolefin sheet may be utilized for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462 and 4,632,869, the disclosure of which is incorporated for reference.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\ \text{of Solid Density}$$

should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 micrometers, preferably from 20 to 70 micrometers. Below 20 micrometers, the microvoided sheets may not be thick enough to minimize any inherent non-planarity in the support and would be more difficult to manufacture. At thickness higher than 70 micrometers, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ $g/mm^2/day$. This allows faster emulsion hardening, as the laminated support of this invention does not transmit water vapor from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 micrometers in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula $Ar—C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with a agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin film is utilized.

For the biaxially oriented sheets on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

The total thickness of the top most skin layer should be between 0.20 micrometers and 1.5 micrometers, preferably between 0.5 and 1.0 micrometers. Below 0.5 micrometers any inherent non-planarity in the coextruded skin layer may result in unacceptable color variation. At skin thickness greater than 1.0 micrometers, there is a reduction in the photographic optical properties such as image resolution. At thickness greater that 1.0 micrometers there is also a greater material volume to filter for contamination such as clumps or poor color pigment dispersion.

Addenda may be added to the top most skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre blended at the desired blend ratio. Colored pigments that can resist extrusion temperatures greater than 320° C. are preferred as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments and Irgalite organic blue pigments. Optical brightner may also be added to the skin layer to absorb UV energy and emit light largely in the blue region. $TiO_2$ may also be added to the skin layer. While the addition of $TiO_2$ in the thin skin layer of this invention does not significantly contribute to the optical performance of the sheet it can cause numerous manufacturing problems such as extrusion die lines and spots. The skin layer substantially free of $TiO_2$ is preferred. $TiO_2$ added to a layer between 0.20 and 1.5 micrometers does not substantially improve the optical properties of the support, will add cost to the design and will cause objectionable pigments lines in the extrusion process.

The core of the top sheet caused the reflective whiteness of the sheet. The core may be white because of voiding or the presence of white pigment such as $TiO_2$, or a combination of voiding and pigment.

Addenda may be also added to the core matrix to further improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. A stretching ratio, defined as the final length divided by the original length for sum of the machine and cross directions, of at least 10 to 1 is preferred. After the sheet has been stretched, it is heat set by heating to a temperature sufficient to crystallize or anneal the polymers while restraining to some degree the sheet against retraction in both directions of stretching.

The composite sheet, while described as having preferably at least three layers of a core and a skin layer on each side, may also be provided with additional layers that may serve to change the properties of the biaxially oriented sheet. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented, sheet of the invention is as follows:

| |
|---|
| thin solid skin layer with colorants (exposed side) |
| core layer (voided and/or white pigment) |
| skin layer |

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephthalate such as disclosed in U.S. Pat. Nos. 4,912,333;

4,994,312 and 5,055,371, the disclosure of which is incorporated by reference.

The preferred support is a photographic grade cellulose fiber paper.

When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheet(s) in order to minimize curl in the resulting laminated receiver support. For high humidity applications (>50% RH) and low humidity applications (<20% RH), it is desirable to laminate both a front side and back side film to keep curl to a minimum.

In one preferred embodiment, in order to produce photographic elements with a desirable photographic look and feel, it is preferable to use relatively thick paper supports (e.g., at least 120 micrometers thick, preferably from 120 to 250 micrometers thick) and relatively thin microvoided composite packaging films (e.g. less than 50 micrometers thick, preferably from 20 to 50 micrometers thick, more preferably from 30 to 50 micrometers thick).

As used herein the phrase "imaging element" is a material that may be used as a laminated support for the transfer of images to the support by techniques such as ink jet printing or thermal dye transfer as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pH (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire P010 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 micrometers.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| | I, II, III, IX | hardeners, coating aids, |
| 3 | A & B | addenda, etc. |
| 1 | III, IV | Chemical sensitization and |
| 2 | III, IV | spectral sensitization/ |
| 3 | IV, V | desensitization |
| 1 | V | UV dyes, optical |
| 2 | V | brighteners, luminescent |
| 3 | VI | dyes |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

Photographic Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26% anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 gm/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

EXAMPLES

Example 1

The following laminated photographic bases were prepared by extrusion laminating the following sheets to both sides of a photographic grade cellulose paper support:

Bottom Sheet

BICOR 70MLT (Mobil Chemical Co.)

A one-side matte finish, the other side corona treated polypropylene sheet (18 micrometers thick, d=0.9 g/cc) consisting of a solid oriented polypropylene core. The bottom sheet was extrusion laminated to a photographic grade cellulose paper support with a clear polyolefin (22.5 $g/m^2$) leaving the matte surface exposed.

Top Sheet (Emulsion side)

A composite sheet consisting of 5 layers identified as L1, L2, L3, L4, L5. L1 is the thin colored layer on the outside of the sheet to which the photosensitive silver halide layer was attached. L6 was the extrusion coated adhesive layer used to laminate the top sheet to the paper support.

The top sheet used in this example was coextruded and biaxially oriented. L6 was not part of this coextruded and biaxially oriented film.

FIG. 1 shows the explanation for this example.

FIG. 1

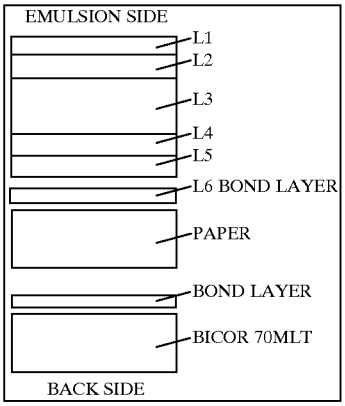

Table 1 lists the characteristics of the layers that were held constant for these examples.

TABLE 1

| Layer | Material | Thickness, micrometers |
|---|---|---|
| L1 | LD Polyethylene + color concentrate | VARIABLE |
| L2 | Polypropylene + 18% TiO2 by wt | 4.32 |
| L3 | Voided Polypropylene | 24.9 |
| L4 | Polypropylene | 4.32 |
| L5 | Polypropylene | 0.762 |
| L6 | LD Polyethylene | 11.4 |

The L3 layer is microvoided and further described in Table 2 where the refractive index and geometrical thickness is shown for measurements made along a series single slices through the L3 layer; they do not imply continuous layers, a slice along another location would yield different but approximately the same thickness. The areas with a refractive index of 1 are voids that are filled with air and the remaining layers are polypropylene.

TABLE 2

| Sublayer of L3 | Refractive Index | Thickness, micrometers |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Table 3 lists the variations in L1 thickness and the percent color concentrate at 100% has the following composition: 0.40% Sun Fast Magenta, 16.68% Sheppard Blue 214 and 82.91% LDPE from Dow Chemical Co. Condition 2 was a base case to calculate the relative amount of color added by the top sheet. The achievement of a functional, accurate optical L1 layer at a thickness less than 1.5 micrometers exceeds any prior art.

TABLE 3

| EXAMPLE | L1 THICK, micrometers | L1 Percent Concentrate | RELATIVE COLOR AMOUNT |
|---|---|---|---|
| 1 | 0.75 | 17% | 0.52 |
| 2 | 0.75 | 33% | 1.00 |
| 3 | 1.5 | 17% | 1.03 |
| 4 | 1.5 | 33% | 2.00 |
| 5 | 1 | 25% | 1.01 |

Table 4 lists the LSTAR lightness values and the ASTAR (green/red) and BSTAR (blue/yellow) ratings for the examples. These ratings are the standard of color measurement in the CIE system measured on a Hunterlab calorimeter. Photographic base papers must have the correct tinting to make them suitable for use in systems which try to reproduce color images correctly.

TABLE 4

| EXAMPLE | ASTAR UVO | BSTAR UVO | L STAR UVO | BSTAR DIFF |
|---|---|---|---|---|
| 1 | 0.18 | −2.59 | 93.93 | 3.26 |
| 2 | 0.67 | −5.12 | 91.92 | 5.79 |
| 3 | 0.85 | −5.85 | 91.71 | 6.52 |
| 4 | 1.7 | −9.65 | 88.74 | 10.32 |
| 5 | 0.89 | −6.16 | 91.33 | 6.83 |
| BASE PAPER | | 0.67 | | 0.00 |

The plots of the relative amount of color added in the top layer vs. the resultant difference in BSTAR (blue/yellow) difference between the final package and the starting point (paper base) labeled as BSTAR DIFF in Table 4, show the excellent linearity of the color control of the L1 layer as a result of the precise control of concentration and layer thickness inherent in the method of manufacture.

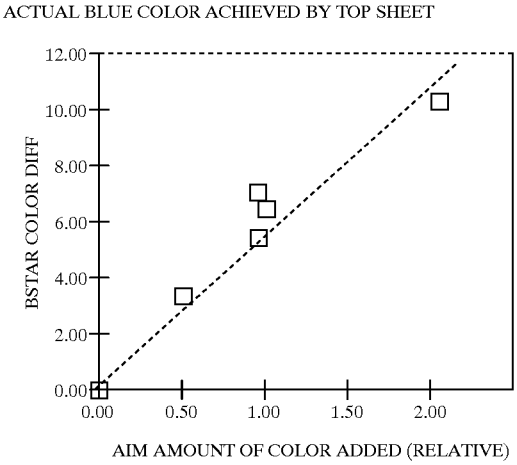

Further analysis of the samples shows that the coextruded and then biaxially oriented top sheet was able to provide extremely accurate color correction of the photographic element using less than one-half of the normal amounts of tinting agents that are used in $TiO_2$ loaded layers of thickness greater than 1.5 micrometers. All other photographic responses were within normal limits, even though the L1 layer did not contain $TiO_2$ which has been traditionally required throughout the top sheet under the emulsion. The down web and cross web variability for color variation were superior to any previous product eliminating the need for expensive thickness control like coating die adjustment by automatic feedback loop systems.

The invention has been described in detail with particular reference to preferred embodiments thereof, but it will be understood that variations and modifications can be effected within the spirit and scope of the invention.

What is claimed is:

1. An imaging element comprising at least one image forming layer comprising an image receiving layer, a colored layer, wherein said colored layer is between about 0.2 μm and 1.5 μm thick, said colored layer contains colored pigments, is an upper surface layer of a biaxially oriented polyolefin polymer sheet and is located below said at least one image forming layer an image receiving layer for ink jet printing or for receiving a dye transfer image.

2. The imaging element of claim 1 wherein said colored layer has a thickness between 0.5 μm and 1.0 μm.

3. The imaging element of claim 1 wherein said biaxially oriented sheet has a core that provides reflectance and opacity.

4. The imaging element of claim 1 wherein said colored layer comprises pigments resistant to a temperature of about 320° C.

5. The imaging element of claim 1 wherein said colored layer is free of titanium dioxide.

6. The imaging element of claim 1 wherein said colored pigments of said colored layer are selected from at least one member of the group consisting of Phthalocyanine blue pigments, Cromophtal blue pigments, Irgazin blue pigments, and Irgalite organic blue pigments.

7. The imaging element of claim 1 wherein the biaxially oriented sheet with the colored upper surface layer is adhesively laminated to a paper sheet on the lower side of said biaxially oriented polyolefin opposite said colored surface layer.

8. The imaging element of claim 7 wherein said paper sheet has another biaxially oriented polymer sheet adhesively attached to the lower side of said paper sheet.

9. The imaging element of claim 8 wherein the upper biaxially oriented polyolefin polymer sheet has at least one layer on the lower side of said colored layer comprising white pigments.

10. The imaging element of claim 9 wherein said white pigments comprise $TiO_2$.

11. The imaging element of claim 9 wherein at least one layer on the lower side of said colored layer comprises voids.

12. The imaging element of claim 1 wherein said polyolefin polymer comprises polypropylene or polyethylene.

13. The imaging element of claim 7 wherein said paper sheet comprises cellulose fibers.

14. The imaging element of claim 1 wherein said upper surface layer comprises polyethylene.

15. An imaging element comprising at least one image forming layer comprising an image receiving layer, a colored layer, wherein said colored layer is between about 0.2 μm and 1.5 μm thick, said colored layer is an upper surface layer of a biaxially oriented polyolefin polymer sheet and is located below said at least one image forming layer an image receiving layer for ink jet printing or for receiving a dye transfer image and wherein said colored layer has a thickness between 0.5 μm and 1.0 μm.

16. The imaging element of claim 15 wherein said biaxially oriented sheet has a core that provides reflectance and opacity.

17. The imaging element of claim 15 wherein said colored layer comprises pigments resistant to a temperature of about 320° C.

18. The imaging element of claim 15 wherein the colorants of said colored layer are selected from at least one member of the group consisting of Phthalocyanine blue pigments, Cromophtal blue pigments, Irgazin blue pigments, and Irgalite organic blue pigments.

19. The imaging element of claim 15 wherein the biaxially oriented sheet with the colored upper surface layer is adhesively laminated to a paper sheet on the lower side of said biaxially oriented polyolefin opposite said colored surface layer.

20. The imaging element of claim 19 wherein said paper sheet has another biaxially oriented polymer sheet adhesively attached to the lower side of said paper sheet.

21. The imaging element of claim 20 wherein the upper biaxially oriented polyolefin polymer sheet has at least one layer on the lower side of said colored layer comprising white pigments.

22. The imaging element of claim 21 wherein said white pigments comprise $TiO_2$ and wherein said colored layer is free of titanium dioxide.

23. The imaging element of claim 20 wherein at least one layer on the lower side of said colored layer comprises voids and said polyolefin polymer comprises polypropylene or polyethylene.

24. The imaging element of claim 19 wherein said paper sheet comprises cellulose fibers.

25. The imaging element of claim 15 wherein said upper surface layer comprises polyethylene.

26. An imaging element comprising at least one image forming layer comprising an image receiving layer, a colored layer, wherein said colored layer is between about 0.2 μm and 1.5 μm thick, said colored layer is an upper surface layer of a biaxially oriented polyolefin polymer sheet and is located below said at least one image forming layer an image receiving layer for ink jet printing or for receiving a dye transfer image and wherein said colored layer comprises pigments resistant to a temperature of about 320° C.

27. The imaging element of claim 26 wherein said biaxially oriented sheet has a core that provides reflectance and opacity.

28. The imaging element of claim 26 wherein said colored layer is free of titanium dioxide.

29. The imaging element of claim 26 wherein the colorants of said colored layer are selected from at least one member of the group consisting of Phthalocyanine blue pigments, Cromophtal blue pigments, Irgazin blue pigments, and Irgalite organic blue pigments.

30. The imaging element of claim 26 wherein the biaxially oriented sheet with the colored upper surface layer is adhesively laminated to a paper sheet on the lower side of said biaxially oriented polyolefin opposite said colored surface layer.

31. The imaging element of claim 30 wherein said paper sheet has another biaxially oriented polymer sheet adhesively attached to the lower side of said paper sheet.

32. The imaging element of claim 31 wherein said colored layer has a thickness between 0.5 μm and 1.0 μm.

33. The imaging element of claim 30 wherein the upper biaxially oriented polyolefin polymer sheet has at least one layer on the lower side of said colored layer comprising white pigments.

34. The imaging element of claim 33 wherein said white pigments comprise $TiO_2$.

35. The imaging element of claim 33 wherein at least one layer on the lower side of said colored layer comprises voids.

36. The imaging element of claim 26 wherein said polyolefin polymer comprises polypropylene or polyethylene.

37. The imaging element of claim 30 wherein said paper sheet comprises cellulose fibers.

* * * * *